US007191705B2

(12) United States Patent
Berg et al.

(10) Patent No.: US 7,191,705 B2
(45) Date of Patent: Mar. 20, 2007

(54) PRINTING DEVICE AND METHOD, IN WHICH A HUMIDITY PROMOTER IS APPLIED PRIOR TO THE INK-REPELLENT OR INK-RECEPTIVE LAYER

(75) Inventors: Martin Berg, Munich (DE); Erich Kattner, Neubiberg (DE); Robert Link, Munich (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 10/505,237

(22) PCT Filed: Feb. 14, 2003

(86) PCT No.: PCT/EP03/01496

§ 371 (c)(1),
(2), (4) Date: Apr. 7, 2005

(87) PCT Pub. No.: WO03/070481

PCT Pub. Date: Aug. 28, 2003

(65) Prior Publication Data

US 2005/0178281 A1 Aug. 18, 2005

(30) Foreign Application Priority Data

Feb. 19, 2002 (DE) ..... 102 06 937

(51) Int. Cl.
*B41C 1/10* (2006.01)

(52) U.S. Cl. ..... 101/465; 101/450.1; 101/478; 101/487

(58) Field of Classification Search ..... 101/463.1, 101/465, 478, 487
See application file for complete search history.

(56) References Cited

U.S. PATENT DOCUMENTS

| | | | | |
|---|---|---|---|---|
| 4,764,776 | A * | 8/1988 | Mugrauer et al. | 347/232 |
| 5,067,404 | A | 11/1991 | Frunder et al. | |
| 5,379,698 | A | 1/1995 | Nowak et al. | |
| 5,816,161 | A | 10/1998 | Nüssel et al. | |
| 6,006,666 | A | 12/1999 | Göttling | |

(Continued)

FOREIGN PATENT DOCUMENTS

| | | |
|---|---|---|
| DE | 101 32 204 | 1/2003 |
| EP | 0 570 879 | 5/1993 |

(Continued)

OTHER PUBLICATIONS

Teschner: "Offsettechnik", 5. Auflage, Felbach, Fachschriften-Verlag 1983, p. 193-202 and S. 350.

*Primary Examiner*—Judy Nguyen
*Assistant Examiner*—Joshua Zimmerman
(74) *Attorney, Agent, or Firm*—Schiff Hardin LLP

(57) ABSTRACT

In a method and device to generate a print image on a carrier material, a surface of a print carrier is coated with a layer which is one of ink-repelling and ink-attracting. In the structuring process, ink-attracting regions and ink-repelling regions are generated. Ink that adheres to the ink-attracting regions and that is not absorbed by the ink-repelling regions is applied on the surface. The applied ink is transferred onto the carrier material. Before a new structure process on the same surface of the print carrier, the surface is cleaned and recoated with said layer. Before the application of said layer, a wetting-aiding substance is applied with a molecular layer thickness. A surfactant with hydrophilic molecule sections is used as the wetting-aiding substance.

28 Claims, 6 Drawing Sheets

U.S. PATENT DOCUMENTS

| | | | | |
|---|---|---|---|---|
| 6,016,750 | A | 1/2000 | Nüssel et al. | |
| 6,125,755 | A * | 10/2000 | Link et al. | 101/451 |
| 6,232,037 | B1 * | 5/2001 | Uesugi et al. | 430/278.1 |
| 6,295,928 | B1 * | 10/2001 | Heinzl et al. | 101/465 |
| 6,318,264 | B1 * | 11/2001 | D'Heureuse et al. | 101/467 |
| 2002/0170452 | A1 | 11/2002 | Heinzl et al. | |
| 2005/0115424 | A1 * | 6/2005 | Wiedemer | 101/153 |

FOREIGN PATENT DOCUMENTS

| | | |
|---|---|---|
| EP | 0 693 371 | 1/1996 |
| WO | WO 97/36746 | 10/1997 |
| WO | WO 98/32608 | 7/1998 |
| WO | WO 00/16988 | 3/2000 |

* cited by examiner

PRINTING DEVICE AND METHOD, IN WHICH A HUMIDITY PROMOTER IS APPLIED PRIOR TO THE INK-REPELLENT OR INK-RECEPTIVE LAYER

BACKGROUND

The method and device concerns generating a print image on a carrier material, wherein on the surface of the print carrier ink-attracting and ink-repelling regions are generated corresponding to the structure of the print image to be generated. The ink-repelling regions are provided with a layer from an ink-repelling medium. Ink that adheres to the ink-attracting regions and is not accepted by the ink-repelling regions is applied on the surface of the print carrier. The ink distributed on the surface is printed on the carrier material.

In the prior art, offset printing methods operating without water are known whose non-printing regions are fat-repelling and therefore accept no printing ink. In contrast, the printed regions are fat-attracting and accept the fat-containing printing ink. Ink-attracting and ink-repelling regions are distributed on the printing plate corresponding to the structure of the print image to be printed. The printing plate can be used for a plurality of transfer printing events. A new plate with ink-attracting and ink-repelling regions must be generated for each print image.

From U.S. Pat. No. 5,379,698, a method (called the Direct Imaging Method) is known in which a printer's copy is created via selective burning-off of the silicon cover layer on a multilayer, silicon-coated film in the printing device. The silicon-free locations are the ink-attracting regions that accept printing ink during the printing event. It requires a new film for each new print image.

In the standard offset method operating with water, hydrophobic and hydrophilic regions are generated on the surface of the print carrier corresponding to the structure of the print image to be printed. Before the application of the ink, a thin moisture film that wets the hydrophilic region of the print carrier is first applied onto the print carrier using application rollers or spray devices. The ink roller subsequently transfers ink onto the surface of the print carrier that, however, exclusively wets the regions not covered with the moisture film. The ink is finally transferred onto the carrier material after the inking.

In the known offset printing method, multilayer, processless thermoprinting plates can be used as print carriers (compare, for example, WO00/16988). On the surface of the print carrier, a hydrophobic layer is removed via partial burn-off and a hydrophilic layer is uncovered, corresponding to the structures of the print image to be printed. The hydrophilic layer can be wetted with an ink-repelling fountain solution. The hydrophobic regions are ink-accepting and can accept printing ink during the print event. A new printing plate must be used to create a new print image.

Furthermore, a method is known from U.S. Pat. No. 6,016,750 in which an ink-attracting substance is separated from a film by means of a thermotransfer method, transferred to the hydrophilic surface of the print carrier and solidified in a fixing process. In the printing process, the hydrophilic regions remaining free are wetted with ink-repelling fountain solution. The ink is subsequently applied on the surface of the print carrier, the ink, however, bonding only on the regions provided with the ink-attracting substance. The inked print image is then transferred onto the carrier material. A new film with the ink-attracting substance is necessary for the creation of a new print image.

In the standard offset method or surface printing method, the wetting of the printing plate with the ink-repelling fountain solution is achieved via a specific roughening and structuring of the plate surface. The surface increase and porosity thereby created generates microcapillaries and leads to an increase of the effective surface energy and thus to a good wetting or spreading of the fountain solution. As further measures, in offset printing wetting-aiding substances are added to the fountain solution. These decrease the surface tension of the fountain solution, which in turn leads to an improved wetting of the surface of the print carrier. The literature Teschner H.: Offsettechnik, 5th edition, Fellbach, Fachschriften-Verlag 1983, pg. 193–202 and pg. 350 is referenced in this context.

From U.S. Pat. No. 5,067,404, a printing method is known in which a fountain solution is applied to the surface of the print format. The fountain solution is vaporized via selective application of radiant energy in image regions. The water-free regions later form the ink-bearing regions that are directed to a developing unit and are inked by means of an ink vapor. Energy-intensive partial vaporization processes are necessary to generate the structured fountain solution film.

Furthermore, the patent documents WO 97/36746 and WO 98/32608 are referenced. In the method specified in WO 97/36746, the fountain solution is generated via vaporization of a discrete water volume that condenses on the surface of the print carrier. According to WO 98/32608 and the U.S. Pat. No. 6,295,928 derived therefrom, a continuous ice film is applied and structured. In both cases, local high thermal energy must be applied for structuring. The aforementioned documents U.S. Pat. No. 5,067,404, WO 98/32608 (U.S. Pat. No. 6,295,928) and WO 97/36746 by the same applicant are herewith included by reference in the disclosure scope of the present patent application.

From DE-A-10132204 (not published) by the same applicant, a CTP method (Computer-To-Press method) is specified whereby multiple structuring processes can be implemented on the same surface of the print carrier. The surface of a print carrier is coated with an ink-repelling or ink-attracting layer. In a structuring process, ink-attracting regions and ink-repelling regions are generated corresponding to the structure of the print image to be printed. The ink-attracting regions are then inked with ink. Before a new structuring process, the surface of the print carrier is cleaned and re-coated with an ink-repelling or ink-attracting layer. A fountain solution layer or an ice layer is used as a layer. This patent document DE-A-10 132 204 is herewith included by reference in the disclosure content of the present patent application.

SUMMARY

It is an object to specify a printing method and a print device that has a simplified design for the digital printing with variable print image and ensures a high print quality.

In a method and device to generate a print image on a carrier material, a surface of a print carrier is coated with a layer which is one of an ink-repelling and ink-attracting. The layer is made from a fountain solution. In a structuring process, ink-attracting and ink-repelling regions are generated corresponding to a structure of the print image to be printed. Ink that adheres to the ink-attracting regions that is not absorbed by the ink-repelling regions is supplied on the surface. The applied ink is transferred onto the carrier material. Before a new structuring process on the same surface of the print carrier, the surface is cleaned and re-coated with said layer. Before the application of said fountain solution layer, a wetting-aiding substance is applied with a molecular layer thickness on the surface of the print carrier. A surfactant with hydrophilic molecule sections is employed as a wetting-aiding substance.

DESCRIPTION OF THE PREFERRED EMBODIMENTS

Figure 1:
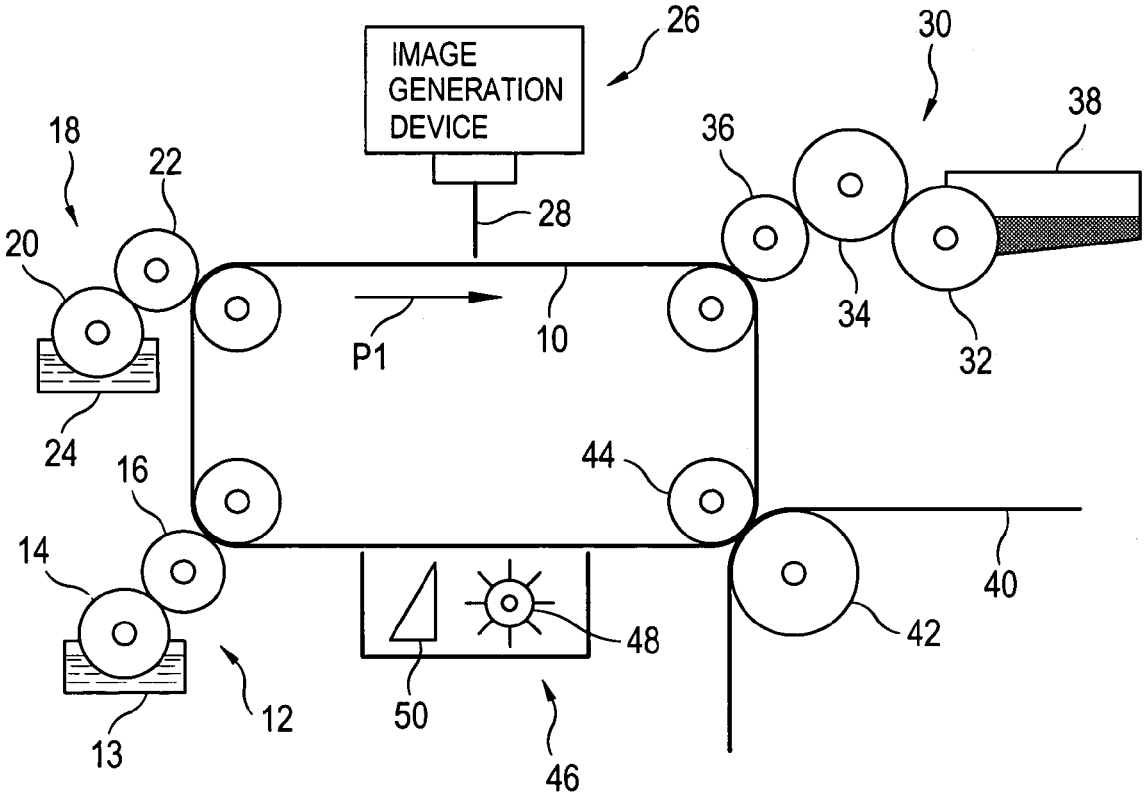
FIG. 1 is a principle representation of a print device in which a surfactant layer is applied.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

According to the method and device, before the application and structuring of the fountain solution layer a wetting-aiding substance is applied on the surface of the print carrier in molecular layer thickness. The wetting and coating are accordingly separated from one another, whereby the fountain solution does not have to be loaded with a wetting agent. The method provides for the use of a very smooth surface of the print carrier, whereby the subsequent process steps are simplified, in particular the cleaning before a restructuring in digital printing. Moreover, the wear of the print surface is reduced.

It is to be noted that the term ink-repelling or ink-accepting layer occurs frequently in the further specification. This layer is adapted to the ink to be applied. For example, given a water-containing fountain solution layer and an oil-containing ink, the fountain solution layer is ink-repelling. However, if the ink is water-containing, this fountain solution layer is ink-attracting. In practice, oil-containing inks are predominantly used, such that a water-containing fountain solution layer is ink-repelling.

In FIG. 1, a principle representation of a print device is shown that is designed similar to how it is specified in U.S. Pat. No. 5,067,404 by the same applicant. A print carrier 10, in the present case a continuous band, is directed through a pre-treatment device 12 that comprises a scoop roller 14 and an application roller 16. The scoop roller 14 dips into a fluid contained in a reservoir 13, the fluid containing a wetting-aiding substance. This substance, which comprises surfactants, is applied in a molecular layer thickness on the surface of the print carrier 10 via the application roller 16. The layer thickness is typically smaller than 0.1 μm. The surface of the print carrier 10 is then directed in arrow direction P1 to a dampening system 18 that, via a scoop roller 20 and an application roller 22, applies an ink-repelling or ink-attracting fountain solution, for example water, from fountain solution reservoir 24 onto the surface of the print carrier 10. In principle, a fountain solution other than water can also be used. The application of the fountain solution layer can also occur via other methods, for example via dampening or spraying. The print-active surface of the print carrier 10 is completely provided with this fountain solution layer. The fountain solution layer typically has a layer thickness smaller than 1 μm.

The generally ink-repelling fountain solution layer is subsequently structured via an image generation device 26. In the present case, a laser beam 28 is used for this. In this structuring process, ink-attracting regions and ink-repelling regions are generated corresponding to the structure of the print image to be printed. The structured fountain solution layer subsequently arrives at an inking system 30 which transfers ink from a reservoir 38 to the surface of the print carrier 10 with the aid of the rollers 32, 34, 36. The oil-containing ink attaches at regions without the water-containing fountain solution. It is to be noted that the ink can also be transferred onto the surface of the print carrier 10 via spraying, scraping or condensation.

Given further transport of the print carrier 10, a transfer printing onto a carrier material 40 (in general a paper web) occurs. For transfer printing, the carrier material 40 is directed through between two rollers 42, 44. In the transfer printing process, a rubber blanket cylinder (not shown) and further intermediate cylinders that effect an ink division as this is known from the field of offset printing methods can be inserted between the roller 42 and the print carrier 10.

Given further transport of the print carrier 10, the surface of the print carrier 10 is cleaned in a cleaning station 46. The ink residues as well as the residues of the surfactant layer are hereby removed. The cleaning station 46 comprises a brush 48 and a wiping lip 50 which are brought into contact with the surface of the print carrier 10. Furthermore, the cleaning can be supported via use of ultrasound, high pressure liquid and/or vapor. The cleaning can also occur using cleaning fluids and/or solvents.

A new application of the wetting-aiding substance, for example a surfactant application, and a fountain solution application as well as a restructuring can subsequently occur. In this manner, a new print image can be printed given every revolution of the print carrier 10. However, it is also possible to print the same print image multiple times. The cleaning device 46, the device 12 and the device 26 are then inactively interposed. The print image still present in ink residues is then re-inked and transfer-printed by the inking system 30. Given this operating type, a plurality of identical print images can thus be printed.

Figure 2:
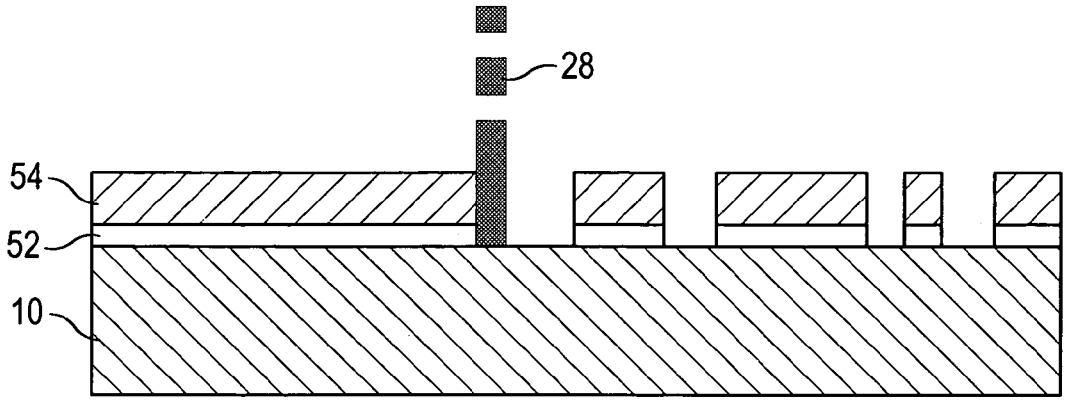
FIG. 2 illustrates schematically a cross-section through the print carrier before and after the structuring by a laser beam.

FIG. 2 schematically shows a cross-section through the print carrier 10 before and after the structuring with the aid of the laser beam 28. According to the preferred embodiment, the wetting via the application of a wetting-aiding substance is conveyed onto the print carrier surface 10. This occurs within the print cycle before the application of the ink-repelling fountain solution. The wetting-aiding substance can be applied on the surface (dependent on its physical and chemical properties) as an extremely thin layer of a few molecule layers, preferably smaller than 0.1 μm. This layer is sufficient in order to promote the wetting with the ink-repelling fountain solution on its free surface, such that this can in turn be applied as a very thin layer 54, preferably smaller than 1 μm. The continuing print process is not impaired by the small quantity of the wetting-aiding substance, in this case a surfactant layer 52. It can easily be removed again via the cleaning process integrated into the print cycle.

Advantages primarily result in the field of surface printing or offset printing, meaning a surface printing method or offset printing method with alternating print information from print cycle to print cycle. Via the wetting-aiding layer 52, the otherwise typical roughened, porous printing plate surface can be foregone. Instead of this, a smooth surface of the print carrier 10 is possible that is to be cleaned with clearly lesser effort. A faster and more stable cleaning event is indispensable for such a digital surface printing method or offset printing method and a decisive factor for its effectiveness. The surface of the print carrier 10 accordingly has a roughness that is smaller than the roughness used in the standard offset printing method. The average surface roughness $R_z$ is typically smaller than 10 μm, and preferably smaller than 5 μm. Expressed as an average roughness value $R_a$, the roughness value is in a range smaller than 2 μm, and preferably smaller than 1 μm.

A change in the molecular or atomic structure of the material of the print carrier as well as a wetting-aiding layer permanently and firmly anchored with the surface of the print carrier is not necessary. The additionally applied wetting-aiding substance (for example the surfactant layer 52) proposed here already deploys its wetting-aiding effect given the smallest quantities. Its influence on the properties of the print carrier 10 in all respects is accordingly negligible. A further advantage results from the now-possible abandonment of the typically present wetting-aiding additives in fountain solutions in offset printing.

According to FIG. 2, the fountain solution layer 54 and the surfactant layer 52 are removed via the laser beam 28 corresponding to the required image structure. These regions are then inked with ink by the inking system 30. The cleaning is eased due to the very smooth surface of the print carrier 10, whereby the surfactant layer 52 is completely removed again. Furthermore, the wear of the surface of the print carrier 10 is reduced.

Figure 3:
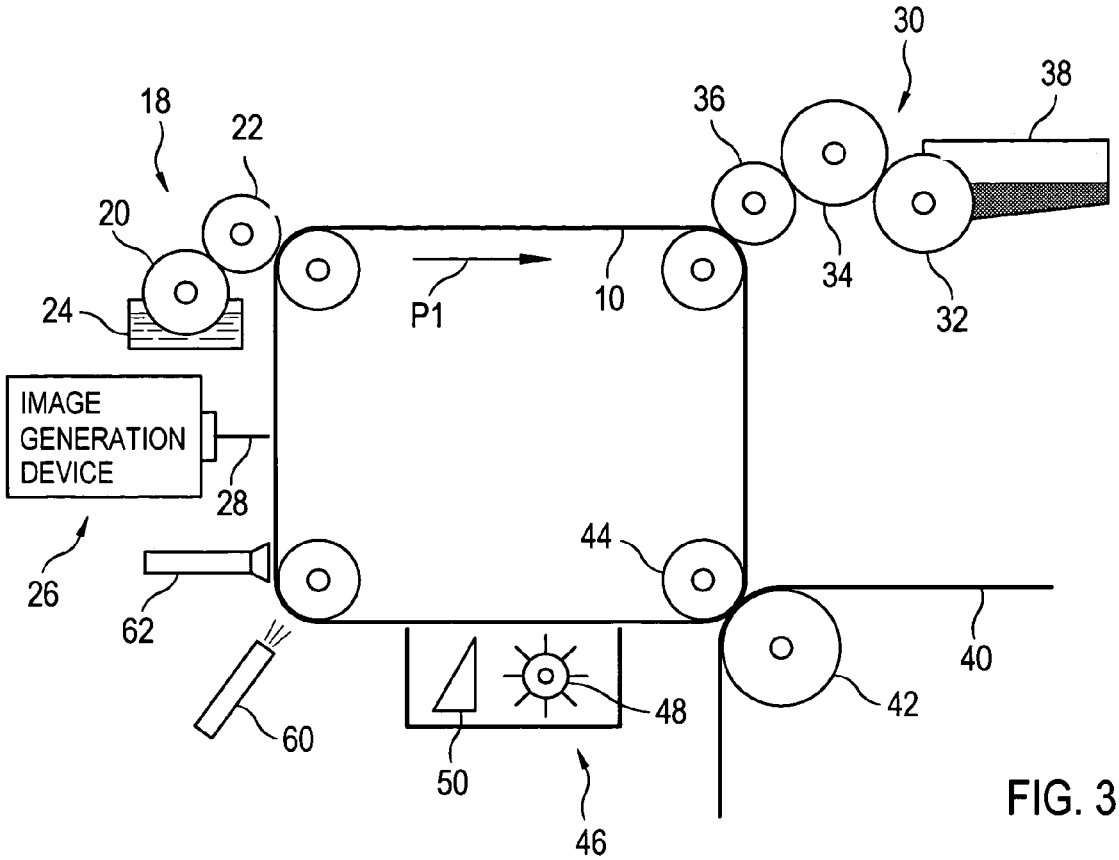
FIG. 3 shows an exemplary embodiment in which a hydrophilized layer is structured.
Figure 4:
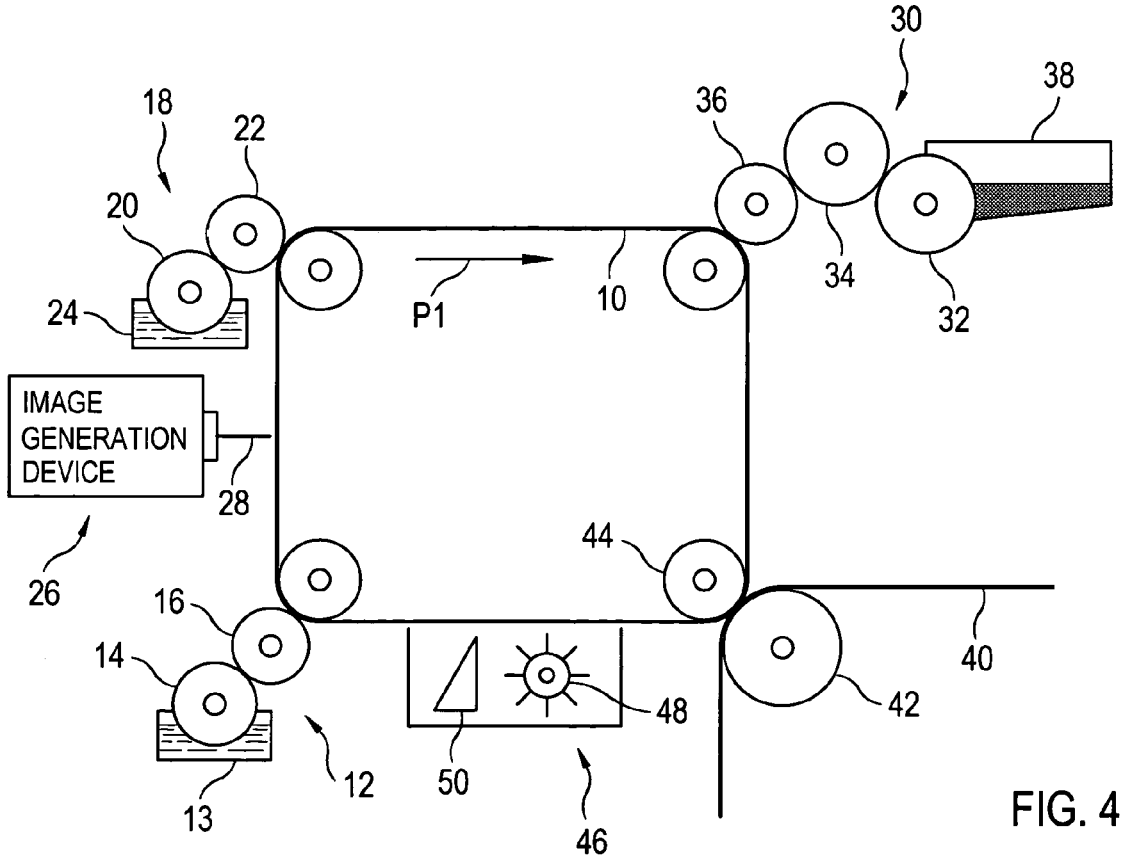
FIG. 4 shows an exemplary embodiment in which an applied hydrophilic layer is structured.
Figure 5:
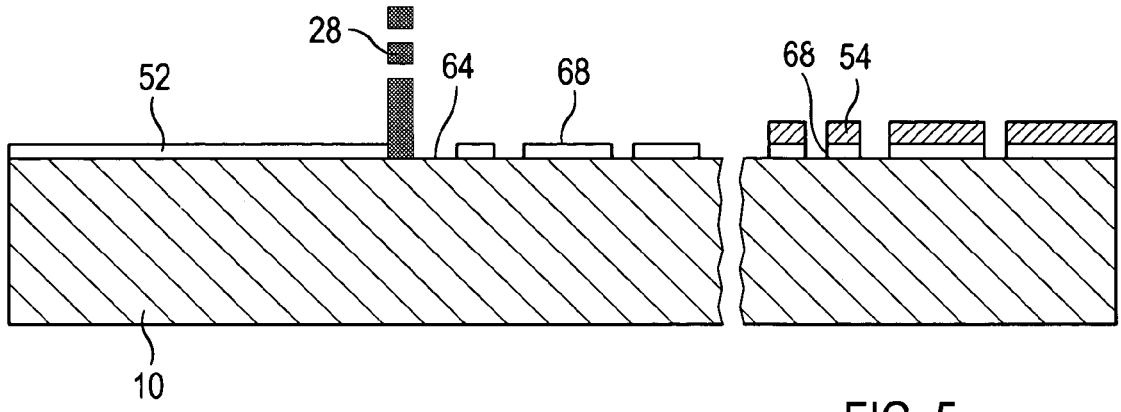
FIG. 5 illustrates a schematic cross-section through the print carrier before and after the structuring of the hydrophilic layer.

In the following Figures, functionally identical elements are designated identically. FIGS. 3, 4 and 5 show a further exemplary embodiment of the invention. In FIG. 3, in contrast to the exemplary embodiment according to FIG. 1, before the application of the ink-repelling or ink-attracting layer on the usable surface of the print carrier a structuring of a hydrophilic layer occurs with a molecular layer thickness. In the present example, a vapor device 60 is used that charges the surface of the print carrier 10 with hot water vapor. The print carrier 10 is provided with an SiO2 coating on its surface. After the vapor treatment, the print carrier 10 is dried via a suction device 62. The hot water vapor generates a hydrophilic molecule structure, for example SiOH, on the outer surface.

After the subsequent structuring via the structuring device 26 by means of laser radiation 28, hydrophilic and hydrophobic regions are created corresponding to the structure of the print image to be printed. Via the downstream dampening system 18, the entire usable surface of the print carrier 10 is contacted with a fountain solution layer, whereby the fountain solution attaches only to the hydrophilic regions, such that ink-attracting regions and ink-repelling regions are created corresponding to the aforementioned structuring. An ink application via the inking system 30 subsequently occurs, whereby the oil-containing ink attaches to regions without water-containing fountain solution. The transfer printing of the print image onto the carrier material 40 subsequently occurs.

After the further transport of the print carrier 10, its surface is cleaned in a cleaning station 46. The ink residues and the residues of a possible wetting-aiding substance are removed. A new structuring process can subsequently occur.

In the present example according to FIG. 3, the hydrophilic layer on the surface of the print carrier 10 is structured corresponding to the print image. The hydrophilic layer is extremely thin and is only a few nanometers, typically smaller than 4 nm. It can therefore by structured with very low energy expenditure during a print cycle, whereby the hydrophilic molecule layer disappears. The fountain solution application, which generates a fountain solution film only on the non-hydrophilic regions, subsequently occurs. Inking and transfer printing occurs according to the specified known principles of surface printing or offset printing. After the cleaning, in which the hydrophilic layer can also be removed (however does not absolutely have to be removed) in addition to the ink residues, the print cycle can begin anew. The hydrophilic layer is regenerated or reapplied and the hydrophilic layer is subsequently structured corresponding to the new image data.

In the example according to FIG. 3, the generation of the hydrophilic layer occurs via activation of the surface of the print carrier and via a suitable change of the external molecular surface structure. For example, this can be enabled via the use of chemical activators, reactive gases and/or a suitable energy supply. In addition to the use of water vapor as in the example according to FIG. 3, a hydrophilic SiOH structure can be designed on the surface via the effect of hot water and via alkaline solutions (such as, for example, NaOH). For this, the print carrier is to be provided with an $S_1O_2$ coating. It is also possible that the print carrier passes through an activator bath in order to generate a hydrophilization of the surface. The application of an activator via a jet system is also possible. A further possibility is to generate the hydrophilic layer via firing the surface of the print carrier 10. Wetting-aiding surface structures are also hereby created in a molecular layer thickness.

An advantageous arrangement is the combination of the hydrophilization with the cleaning. Thus, for example, both the cleaning and the hydrophilizing effect of a hot water jet or a hot water vapor jet can be used. The cleaning and the generation of the hydrophilic layer are then implemented in a single process step.

A further variation is shown in FIG. 4. A wetting-aiding substance is applied to the surface of the print carrier to generate the hydrophilic layer. For example, the pre-treatment device 12 specified in the embodiment according to FIG. 1 can be used. With the aid of the scoop roller 14 and the application roller 16, a fluid from the reservoir 13 can be applied that comprises a wetting-aiding substance, for example a surfactant, in a molecular layer thickness. Here as well the layer thickness is typically smaller than 0.1 μm. Alcohols are also considered as a further wetting-aiding substance. The application can alternatively occur via scraping on, spraying on, and vapor deposition.

Due to the very thin hydrophilic layer in molecular layer thickness, the partial removal of this hydrophilic layer can occur via local thermal energy supply. The energy expenditure can be low due to the low layer thickness. In addition to the laser radiation 28 used in FIGS. 3 and 4, laser diodes, LEDs, LED combs or heating elements can also be used.

In the example according to FIGS. 3 and 4, a restructuring can also occur per cycle of the print carrier 10, whereby a new print image is printed per cycle. However, it is also possible (as in the example according to FIG. 1) to print the same print image multiple times, whereby the existing print image is re-inked and transfer-printed by the inking system 30. The devices for the restructuring are then inactively interposed.

FIG. 5 shows a cross-section through the print carrier 10 before and after the structuring via the laser beam 28 for the example according to FIG. 4. The surface of the print carrier 10 is very smooth, as this is also the case in the preceding examples. The thin surfactant layer 52 is structured by the laser beam 28, meaning hydrophilic regions 68 and hydrophobic layers 64 are generated. A thin, water-containing moisture film is applied by the dampening system 18 only on the hydrophilic regions. The regions 64 are then inked by the inking system 30 with an oil-containing ink that is repelled by the fountain solution 54 in the area of the hydrophilic regions 68.

The subsequent exemplary embodiments according to FIGS. 6 through 9 describe the hydrophilization of the surface of the print carrier 10 via charging with free ions. These exemplary embodiments can also be combined with the example according to FIG. 3.

In order to ensure a good wetting with the generally ink-repelling fountain solution film, the surface energy of the print carrier 10 must be at least as high as the surface tension of the fountain solution film. This means that the value of the contact angle between the surface of the print carrier 10 and the fountain solution must assume a value below 90°. In practice, it is necessary that a contact angle of <25° has to be achieved in order to generate the necessary liquid film with a thickness of approximately 1 μm. This places a high demand on the surface energy of the print carrier, primarily when one considers the extremely high surface tension value of water, namely 72 mN/M, as a basis of the ink-repelling fountain solution. Plastic print carriers or metallic print carriers can not achieve this without further techniques such as, for example, roughening, application of surfactants, generation of microcapillaries, etc. For example, the contact angle of water to polyimide or polycarbonate is approximately 75°. Even metal surfaces that, in their purest form, exhibit very high surface energies and thus the smallest contact angles show relatively hydrophobic behavior under normal environmental conditions. This is substantially connected with the oxidation layer acting on metal surfaces that always forms under normal conditions. Even the slightest impurities have a negative effect in this context for the desired surface energy. Contact angles of over 70° are herewith frequently to be encountered in practice.

Figure 6:
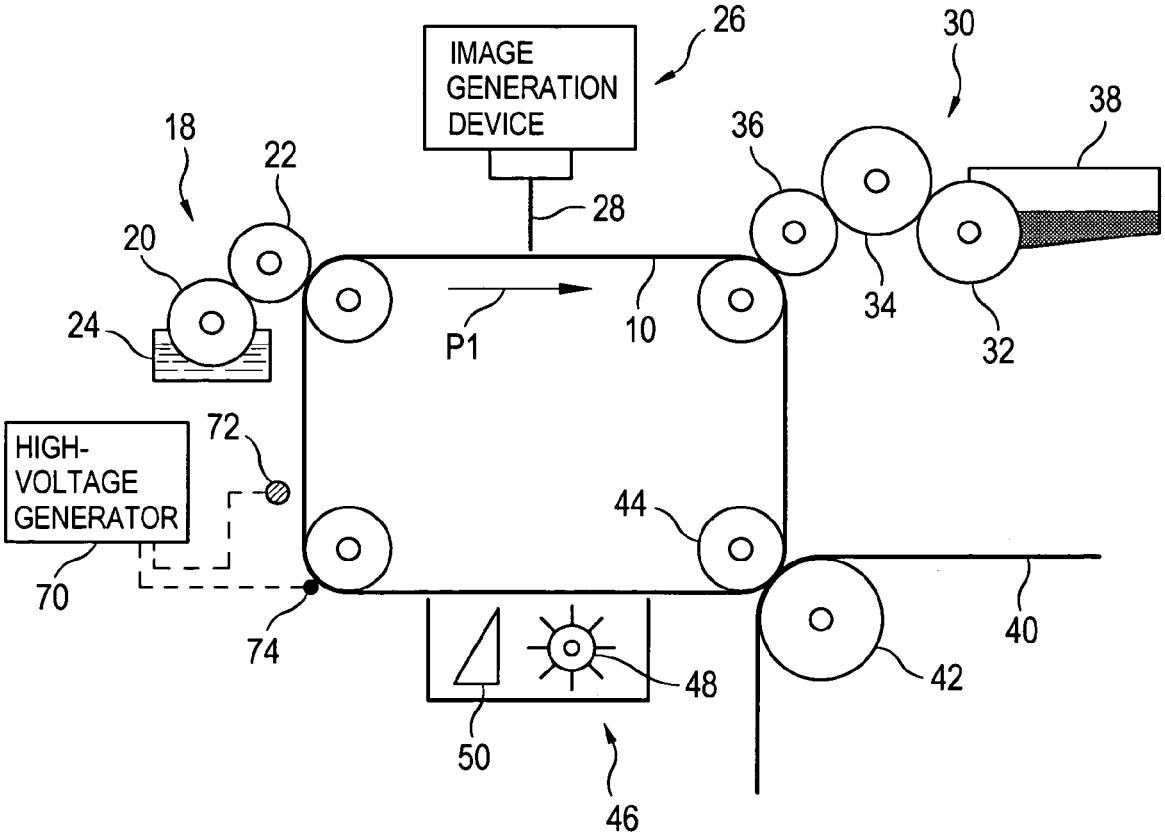
FIG. 6 is an exemplary embodiment in which the hydrophilization occurs via a corona discharge.

In the example according to FIG. 6, a corona treatment of the surface of the print carrier 10 is effected for hydrophilization. A high-voltage generator 70 generates an alternating voltage in the range of 10 to 30 kV, preferably in the range of 15 to 20 kV, at a frequency of 10 to 40 kHz, preferably in the range of 15 to 25 kHz. An output connection of the high-voltage generator 70 is connected with an insulated electrode 72. The other output connection is, in the present case of a metallic print carrier 10, attached to a loop contact 74 that is connected with the print carrier 10.

The relatively high voltage at the electrode 72 leads to ionization of the air. A corona discharge is created, whereby the surface of the print carrier 10 is bombarded with free ions. Given a plastic surface, in addition to a cleaning effect in which organic impurities such as fat, oil, wax, etc. are typically removed, this leads to the creation of free radicals on the surface that form strongly hydrophilic functional groups in connection with oxygen. They are hereby primarily carbonyl groups (—C═O—), carboxyl groups (HOOC—), hydroperoxide groups (HOO—) and hydroxyl groups (HO—). Given metallic print carriers, the cleaning effect is in the foreground, whereby an increase of the surface energy, and thus a reactivation of the hydrophilic properties of metals, is achieved via degreasing of the surface and removal of the oxide layer. In this manner, contact angles to water of under 20° can be achieved with plastic surfaces and with metal surfaces. The corona treatment modifies the physical surface properties of the carrier beforehand, however not its mechanical properties. No visible changes are detectable, for example with a scanning electron microscope. Via variation of the height of the voltage or the frequency of the high-voltage generator, the effect on the surface of the print carrier 10 can be influenced and attuned to the respective carrier material. The hydrophilization can be improved via supply of process gases, preferably oxygen or nitrogen.

In FIG. 6, as in the example according to FIG. 1, a fountain solution is applied onto the hydrophilized surface of the print carrier 10 in the dampening system 18; and a structuring with the aid of laser radiation 28 subsequently occurs. The structured fountain solution layer is inked by the inking system 30 and the ink is later transfer-printed onto the carrier material 40. Ink residues are removed in the cleaning station 46. Since the surface of the print carrier 10 is very smooth, just as in the previous example, the cleaning process is simple and is to be realized with high effectiveness. The cyclical printing process can subsequently start anew. Alternatively, a restructuring can also be omitted and the previous print image is re-inked and transfer-printed.

Figure 7:
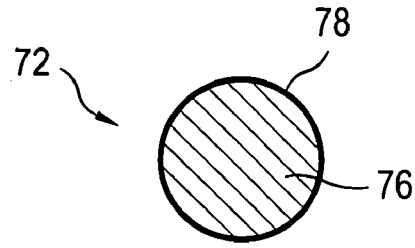
FIG. 7 is a cross-section through an insulated electrode.

FIG. 7 shows the insulated electrode 72. A metallic core is surrounded by a ceramic jacket 78. In such a design, electrical arc-overs are prevented. This is primarily advantageous when metal is used as a print carrier 10. Alternatively, the insulation can also be generated via a plastic jacket.

Figure 8:
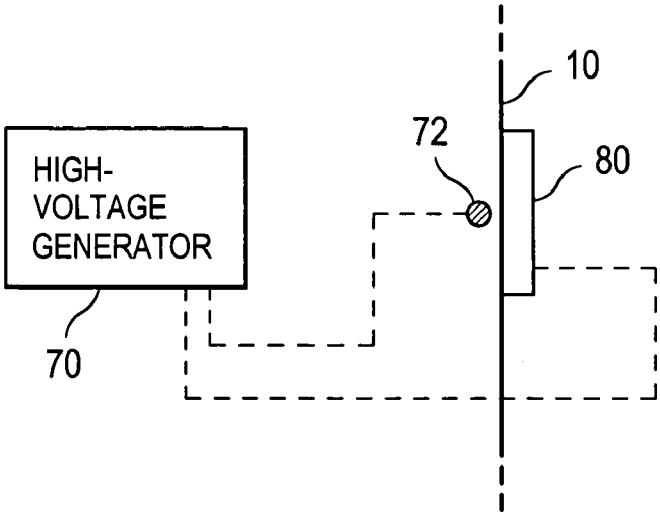
FIG. 8 is an arrangement in a plastic print carrier.

FIG. 8 shows the design in a print carrier 10 made from plastic. An electrode plate 80 is arranged on the side of the print carrier 10 that lies opposite the electrode 72. The electrode 72 can be executed without insulation.

Figure 9:
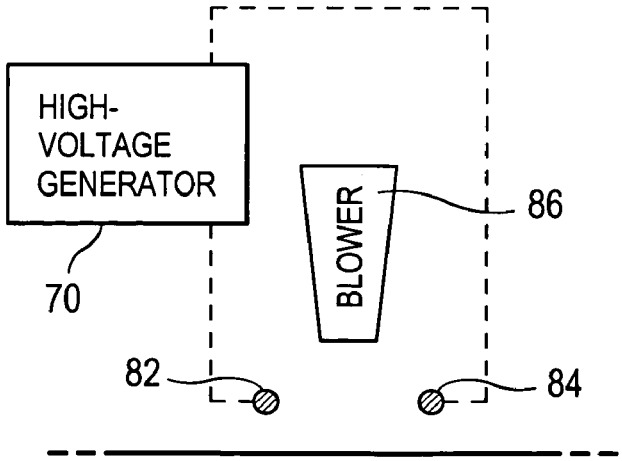
FIG. 9 is an example for an indirect corona discharge.

FIG. 9 shows a hydrophilization method with an indirect corona treatment. The output connections of the high-voltage generator 70 are connected with two electrodes 82, 84 that are arranged above the print carrier 10. The electrical discharges generated by the high voltage between the two electrodes 82, 84 generate ions that are conducted via an air flow or process gas flow onto the surface of the print carrier 10 and here deploy the wetting-aiding effect. A blower 86 is used to generate the flow.

Alternatively, a negative pressure plasma treatment can also be used that increases the surface energy on the surface of the print carrier 10. A high voltage discharge is hereby generated under vacuum conditions (for example in the range of 0.3 to 20 mbar), ionized by the process gas and excited into the plasma state. This plasma comes in contact with the surface of the print carrier 10. The effect of the plasma is comparable with the effect of the corona treatment.

A significant increase of the surface energy, which enables a very thin application of the frequency range fountain solution, is achieved with the aid of the hydrophilization process specified in FIGS. 6 through 9. The layer thickness is typically in the range of 1 μm.

Various advantages result via the specified hydrophilization method. The roughened, porous printing plate surface as in the standard offset printing method can be foregone. Instead of this, a very smooth surface is possible whose roughness range is very low, for example in a range of the average roughness value $R_a$<1 μm. A faster and more stable cleaning event is thereby possible for the surface. For the specified printing process, neither a permanent change in the molecular or atomic structure of the material of the print carrier nor a wetting-aiding layer permanently and firmly anchored with the print carrier is necessary. Via the specified hydrophilization process, the print carrier can be optimized with regard to further requirements without consideration of the surface energy.

The specified hydrophilization process also enables the omission of the wetting-aiding additives for fountain solution used in offset printing. A further application of additional wetting-aiding substances is no longer necessary. This prevents a relatively complicated process management and reduces the additional expenses on commodities. A further advantage is also in the cleaning effect of the hydrophilization method. It supports the cleaning process necessary for the digital printing method and thus further reduces the necessary hardware expenditure.

Figure 10:
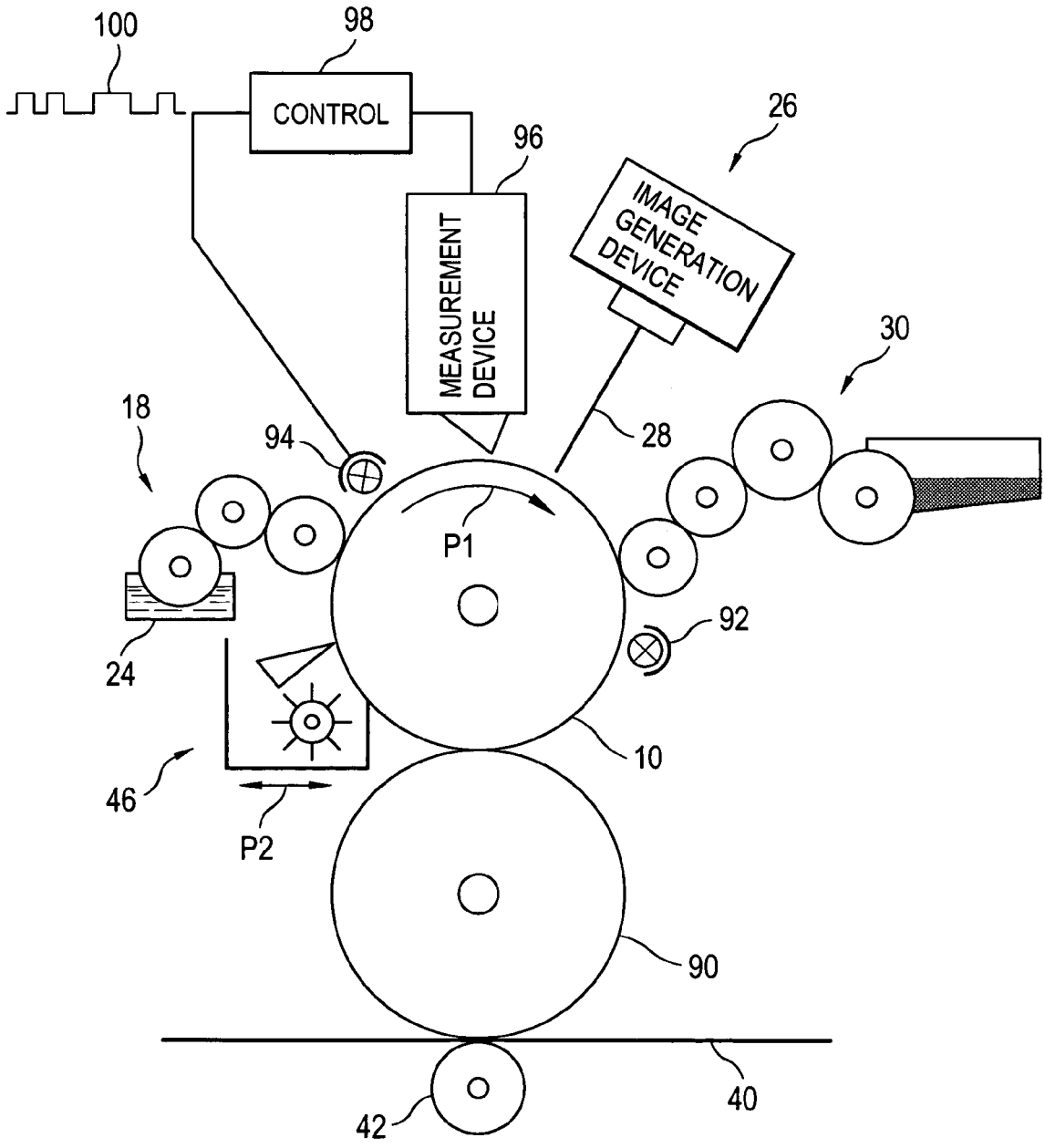
FIG. 10 illustrates a print device with a regulation of the fountain solution layer thickness.

FIG. 10 shows a further exemplary embodiment. In offset printing and in particular in the digital methods, for example according to U.S. Pat. No. 5,067,404 and U.S. Pat. No. 6,295,928 by the same applicant, the constant and precisely defined thickness of the fountain solution layer on the surface of the print carrier plays a decisive role for the stability and the efficiency of the printing method. According to the example according to FIG. 10, a print device is specified that provides and monitors a defined, controllable and regulatable very thin application of the fountain solution. In the standardized offset printing method, a dampening system is normally comprised of a number of rotating rollers used for the application of the fountain solution. Together with a roughened or porous printing plate holding well water, a water film sufficiently stable for the standard offset printing results. The fountain solution quantity and the thickness of the fountain solution layer can, for example, be adjusted via the adjustment of specific rollers relative to one another or the speed of the scoop roller. The storage effect of the dampening system as well as that of the printing plate hereby leads to a significantly retarded reaction to adjustment measures. However, for the generation of a sufficiently stable water film, the roughened, good water-storing printing plates are absolutely necessary. From the prior art, it is also known to generate a very thin water film via cooling of the printing plate and the subsequent condensation of the humidity on the printing plate. The thickness of the water film is, however, strongly dependent on the environmental conditions such as humidity and temperature and is hard to keep constant over longer periods of time.

In the exemplary embodiment according to FIG. 10, a design is used that is similar to the design specified in the previously mentioned DE-A-101 32 204, which realizes a CTP method (Computer-To-Press method).

The print device shown in FIG. 10 allows different print images to be generated on the same surface of the cylindrical print carrier 10. The print device comprises the inking system 30 with a plurality of rollers via which oil-containing ink is transferred from the reservoir 38 onto the surface of the print carrier 10. The inked surface of the print carrier 10 transfers the ink onto a rubber blanket cylinder 90. From there, the ink arrives on the paper web 40, which is pressed against the rubber blanket cylinder 90 via the counter-pressure cylinder 42.

The dampening system 18 transfers fountain solution (for example water) via three rollers from the fountain solution reservoir 24 onto the surface of the print carrier 10. Before the application of the fountain solution layer, the surface of the print carrier 10 can be brought to a hydrophilic state (as this has already been specified further above) using wetting agents and/or surfactants or via a corona and/or plasma treatment. In the further course, the fountain solution layer is selectively removed via energy supply by means of a laser beam 28 and the desired image structure is created. As mentioned, the inking via the inking system 30 subsequently occur on the ink-attracting regions of the structuring. After the structuring, the ink can be solidified by means of a fixing device 92.

In this example, two operating modes are also possible. In a first operating mode, a plurality of printing events occurs before a restructuring of the surface. The print image located on the print carrier 10 is inked and transfer-printed once per printing, meaning a multiple inking of the print image occurs. In a second operating mode, a new print image is applied on the surface of the print carrier. For this, the previous structured ink-repelling layer as well as the ink residues are to be removed, for which the cleaning station 46 is provided. This cleaning station can be pivoted onto the print carrier 10 according to the arrow P2 and pivoted away again from said print carrier 10. Further details of the design of the print device according to FIG. 10 are specified in the mentioned DE-A-101 32 204.

Viewed in the transport direction P1, an energy source 94 that emits heat energy onto the fountain solution film on the surface of the print carrier 10 is arranged after the dampening system 18. The thickness of the fountain solution layer is reduced with the aid of this energy. Viewed in the transport direction, a layer thickness measurement device 96 is encamped after the energy source. This layer thickness measurement device 96 determines the current thickness of the fountain solution film and emits an electrical signal corresponding to the thickness to a control 98. The control 98 compares the measured real thickness with a predetermined desired thickness. Given a desired-real value deviation, the energy source 94 is activated such that the thickness of the fountain solution layer is reduced to the desired thickness.

The layer thickness measurement device 96 can, for example, operate without contact according to the triangulation method, the transmission method or the capacitive method. One or more IR lamps, heat radiators, laser systems, laser diodes or heating elements are suitable as energy sources 94.

The cooperation of the energy source 94, the layer thickness measurement device 96 and the control 98 can be such that only a monitoring function is effected. When the layer thickness undershoots or overshoots a predetermined desired value, a corresponding warning signal is emitted and the energy supply for the energy source 94 is readjusted based thereon. The energy source 94, the layer thickness measurement device 96 and the control 98 can, however, also be incorporated into a control circuit in which the energy source 94 is activated such that, given a standard deviation between real value and desired value of the layer thickness, this standard deviation is minimized and preferably regulated to zero.

The energy source 94 can be activated by the control with the aid of an analog voltage regulation or digitally via a pulse modulation, as this is indicated by the signal series 100.

According to the example according to FIG. 10, in a first process step a fountain solution film that is constant in terms of thickness is generated over the useable width of the print carrier 10, the fountain solution film being reduced in terms of its layer thickness defined in a subsequent second step. The result is a uniform fountain solution layer with defined and very slight thickness. The subsequent structuring can thus be implemented with minimal energy and with invariable result. Overall, the print quality is thus increased. The advantages of the illustrated print device are that an immediate reaction to a change of the layer thickness of the fountain solution layer can layer, that a known and defined thickness of the fountain solution layer can be set, and that extremely thin fountain solution layers can be generated. The necessary structuring energy can also be minimized, in particular for digital printing methods.

Figure 11:
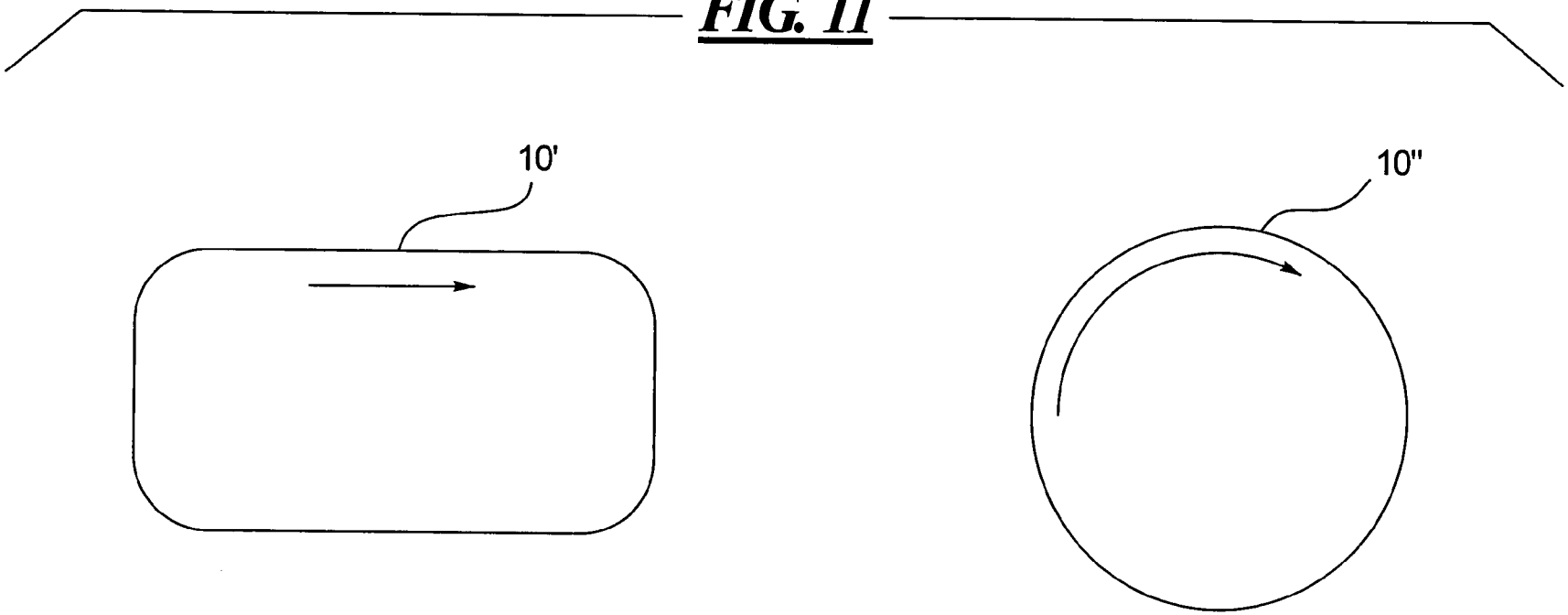
FIG. 11 shows the print carrier as a band or a cylinder.

Numerous further variations of the previously specified exemplary embodiments are possible. For example, both a continuous band 10' and a cylinder 10" as shown in FIG. 11 can be used as the print carrier 10. The transfer printing onto the carrier material can occur directly or under interposition of a rubber blanket cylinder or further intermediate cylinders for an ink separation. The layer thickness regulation according to the example according to FIG. 10 can also be used for the other examples. Likewise, a fixing of the applied ink with the aid of a fixing device can occur for the examples according to FIGS. 1 through 9. Furthermore, the cleaning station 46, the dampening system 18 and the image generation device can be inactively and actively interposed, for example via swinging.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

The invention claimed is:

1. A method to generate a print image on a carrier material, comprising the steps of:

applying a wetting-aiding substance with a molecular layer thickness on a surface of the print carrier, using as the wetting-aiding substance a surfactant with hydrophilic molecule sections, and a layer thickness for the wetting-aiding substance being smaller than 0.1 μm;

in a structuring process, generating at the surfactant regions used for forming ink-attracting regions and ink-repelling regions corresponding to a structure of the print image to be printed;

after the structuring process coating the surfactant on the surface of the print carrier with a layer which is one of ink-repelling and ink-attracting, said layer being made from a fountain solution, and forming said ink-attracting and ink-repelling regions;

applying on the fountain solution layer ink that adheres to the ink-attracting regions and that is not absorbed by the ink-repelling regions;

transferring the applied ink onto the carrier material; and before a new structuring process on the same surface of the print carrier, cleaning and re-coating the surface with said fountain solution layer.

2. A method according to claim 1 wherein said fountain solution layer is ink-repelling and the fountain solution is based on water.

3. A method according to claim 1 wherein the fountain solution layer is ink-repelling and a layer thickness of the ink-repelling layer is smaller than 1 μm.

4. A method according to claim 1 wherein the surface of the print carrier has a roughness that is smaller than a roughness used in a standard offset printing method.

5. A method according to claim 4 wherein an average roughness is smaller than 10 μm.

6. A method according to claim 4 wherein an average roughness of the surface of the print carrier is smaller than 2 μm.

7. A method according to claim 1 wherein digitally-controlled radiation is used for the structuring.

8. A method according to claim 7 wherein the radiation of at least one of a laser system, a laser, laser diodes, LEDs and a laser diode array is used.

9. A method according to claim 1 wherein a plurality of printing events occurs before a restructuring of the surface, and the print carrier is inked multiple successive times.

10. A method according to claim 1 wherein the surface of the print carrier comprises one of a continuous band and a generated cylinder surface.

11. A method according to claim 1 wherein an ink separation occurs before the transfer of the ink onto the carrier material.

12. A device to generate a print image on a carrier material, comprising:

a pre-treatment station which applies a wetting-aiding substance in molecular layer thickness on a surface of a print carrier, a surfactant with hydrophilic molecule sections being used as the wetting-aiding substance, and a layer thickness for the wetting-aiding substance being smaller than about 0.1 μm;

an image generation station which structures the surfactant to create regions used for forming ink-repelling regions corresponding to a structure of the print image to be printed;

a fountain solution application station which coats the surfactant on the surface of the print carrier with a layer which is one of ink-repelling and ink-attracting, said layer comprising a fountain solution, and forming said ink-attracting and ink-repelling regions; an ink application station wherein ink is applied which adheres to the ink-attracting regions and is not absorbed by the ink-repelling regions;

a transfer printing station at which the ink is transferred onto the carrier material;

before a new structuring on the same surface of the print carrier, a cleaning station which cleans the surface of the print carrier; and said fountain solution application station being located between said image generation station and said ink application station.

13. A device according to claim 12 wherein the fountain solution layer is ink-repelling, and the fountain solution is based on water as an ink-repelling layer.

14. A device according to claim 12 wherein the fountain solution layer is ink-repelling and a thickness of the layer is smaller than 1 μm.

15. A device according to claim 12 wherein an average roughness of the surface is smaller than 10 μm.

16. A device according to claim 12 wherein an average roughness of the surface of the print carrier is small than 2 μm.

17. A device according to claim 12 wherein digitally-controlled radiation is used for the structuring.

18. A device according to claim 17 wherein radiation of at least one of a laser system, a laser, laser diodes, LEDs and a laser diode array is used.

19. A method to generate a print image on a carrier material, comprising the steps of:

covering a surface of a print carrier with a wetting-aiding surfactant layer;

in a structuring process generating what will become ink-attracting regions and ink-repelling regions via structuring of the surfactant layer corresponding to a structure of the print image to be printed, and wherein to structure the surfactant layer, radiation of a light source is directed via a control element per image point onto the surfactant layer dependent on a control signal;

after the structuring process covering the surface with a fountain solution layer to create said ink-attracting and ink-repelling regions;

applying at the surface ink that adheres to the ink-attracting regions and that is not absorbed by the ink-repelling regions; and transferring the applied ink onto the carrier material.

20. A method according to claim 19 wherein the surfactant layer is less than 0.1μm.

21. A device to generate a print image on a carrier material, comprising:

a pre-treatment device that applies a wetting-aiding surfactant layer onto a surface of a print carrier;

an image generating station in which in a structuring process what will become ink-attracting regions and ink-repelling regions are generated in the surfactant layer corresponding to a structure of the print image to be printed;

a dampening station which applies a fountain solution layer on said surface to create said ink-attracting regions and ink-repelling regions;

an ink application station wherein ink that adheres to the ink-attracting regions and that is not absorbed by the ink-repelling regions is applied on the surface;

an ink transfer station wherein the applied ink is transferred onto the carrier material;

the image generating station having a light source whose radiation is directed via a control element per image point toward the surface of the print carrier; and the radiation being dependent on a control signal; and said dampening station being located between said image generation station and said ink application station.

22. A device according to claim 21 wherein the surfactant layer is less than 0.1 μm.

23. A device according to claim 21 wherein a wavelength of radiation radiated by said light source is adapted to the surfactant layer.

24. A device according to claim 21 wherein the print carrier comprises a band in the shape of a closed loop.

25. A device according to claim 21 wherein the print carrier comprises a band in the shape of a cylinder.

26. A device according to claim 21 wherein a coating system makes the fountain solution layer an ice layer.

27. A device according to claim 21 wherein a cleaning station following the ink station removes remaining portions of the ink and fountain layer.

28. A device according to claim 21 wherein the light source comprises a laser beam.

* * * * *